United States Patent [19]

Dawson et al.

[11] 4,099,080

[45] Jul. 4, 1978

[54] INCANDESCENT LAMP WITH IMPROVED COATING AND METHOD

[75] Inventors: Chester W. Dawson, Basking Ridge; Robert B. Parsons, Livingston, both of N.J.; Douglas M. Mattox, O'Hara Township, Allegheny County, Pa.

[73] Assignee: Westinghouse Electric Corp., Pittsburgh, Pa.

[21] Appl. No.: 783,256

[22] Filed: Mar. 31, 1977

[51] Int. Cl.[2] ..... H01K 1/32; B05D 3/06

[52] U.S. Cl. ..... 313/116; 427/28; 427/29; 427/106

[58] Field of Search ..... 427/106, 27–30; 106/287 S, 73.5; 313/116

[56] References Cited

U.S. PATENT DOCUMENTS

| | | | |
|---|---|---|---|
| 2,545,896 | 3/1951 | Pipkin | 313/116 |
| 2,661,438 | 12/1953 | Shand | 313/116 |
| 2,888,354 | 5/1959 | Smith et al. | 106/287 S |
| 2,921,827 | 1/1960 | Meister et al. | 316/12 |
| 2,922,065 | 1/1960 | Meister et al. | 313/116 |
| 2,963,611 | 12/1960 | Meister et al. | 313/116 |
| 2,988,458 | 6/1961 | Meister et al. | 427/28 |
| 3,125,457 | 3/1964 | Meister | 313/116 |
| 3,961,600 | 6/1976 | Homer et al. | 118/7 |

FOREIGN PATENT DOCUMENTS

| | | | |
|---|---|---|---|
| 2,224,873 | 3/1974 | France | 313/116 |

*Primary Examiner*—John H. Newsome
*Attorney, Agent, or Firm*—R. S. Lombard

[57] ABSTRACT

This invention relates to an incandescent lamp having an improved light diffusing coating carried on the internal surface of the lamp envelope and a method for applying the coating. The coating is a mixture of very finely divided, very low-moisture content powders. The powders substantially comprise a mixture of hydrophilic silica and hydrophobic silica. This coating has been found to be very adherent and substantially free from agglomerations of the silica.

12 Claims, 4 Drawing Figures

ELECTROSTATIC LAMP COATING UNIT

ELECTROSTATIC LAMP COATING UNIT

INCANDESCENT LAMP WITH IMPROVED COATING AND METHOD

BACKGROUND OF THE INVENTION

This invention relates to an incandescent lamp having a light-transmitting envelope and carrying on the internal surface thereof a light diffusing coating and method for applying the coating. The prior art shows a number of compositions for the light diffusing coating as well as a number of methods for applying the same to the lamp envelope. In U.S. Pat. No. 2,545,896, issued to Pipkin is disclosed a method of applying silica to the inner surface of a lamp envelope by the process of burning organosilicates to form a fume or smoke. The resulting silica coating formed by the burning is quite inert with regard to moisture-repossessing characteristics. This process, however, is relatively expensive and does not provide a coating with light-diffusion characteristics which are as good as desired. In U.S. Pat. No. 2,661,438 issued to Shand is disclosed a process of spraying onto a heated lamp, an alkaline-reacting silica aquasol carrying large silica particles. The resulting silica coating is relatively inert to moisture. This process, though, does not provide a coating with desirable light-diffusion because of the large amounts of silica aquasols containing large silica particles that must be used. In U.S. Pat. No. 2,921,827 dated Jan. 19, 1960 issued to Meister et al and assigned to the present assignee is disclosed a method of applying a silica coating to an incandescent lamp envelope electrostatically. The electrostatic method as disclosed in the Meister patent has been found to be an excellent lamp coating process. This process gives an excellent light-diffusing coating which may be applied quickly and relatively easily. Some problems with the Meister process have been encountered in actual lamp manufacture where the silica powder used to coat the lamp contains an appreciable amount of moisture and because of maladjustments, the coating equipment has failed to remove as much of the moisture as desired. Moisture has a deleterious effect on lamp life, especially in a hot or enclosed-type fixtures where reaction with the filament can occur.

SUMMARY OF THE INVENTION

There is provided an incandescent lamp having a light-transmitting envelope and carrying on the internal surface of the envelope a thin light-diffusing coating substantially comprising a mixture of very finely divided, very low-moisture content powder, and a method for applying the coating to the envelope. The powder substantially comprises a mixture of hydrophilic silica and hydrophobic silica.

When the hydrophilic silica powder used is coarse, that is, having an average particle diameter of at least 40 nm and an average surface area of less than about 65 $m^2/g$, finely divided titania is desirably included in the coating to promote adhesion to the lamp envelope. A coating containing coarse hydrophilic silica powder preferably contains 40 to 95 wt.% hydrophilic silica powder, 10 to 40 wt.% hydrophobic silica powder, and 5 to 40 wt.% titania.

When the hydrophilic silica powder used is fine, that is, having an average particle diameter of less than about 25 nm and an average surface area of at least 100 $m^2/g$, the coating preferably contains hydrophilic silica in amount of from about 70 to 99.5 wt.% and hydrophobic silica in amount of from about 0.5 to 30 wt.%. The resulting coating achieved is very adherent and is substantially free from agglomerations.

BRIEF DESCRIPTION OF THE DRAWINGS

For a better understanding of the invention, reference may be had to the exemplary embodiment shown in the accompanying drawings in which.

DESCRIPTION OF THE PREFERRED EMBODIMENTS p This invention relates to an incandescent lamp having a light-diffusing coating carried on the internal surface thereof and a method for electrostatically applying the same. The coating includes sub-micron sized silica powder. The powder typically used in the coating process is hydrophilic, i.e., having great affinity for moisture, containing adsorbed atmospheric moisture in the range of 12–14 wt.%, such as that manufactured by PPG Industries, Inc. under the trade designation Hi Sil 233. As the moisture content of the silica increases, its electrostatic charging potential decreases. Under normal conditions, when the moisture of the silica powder is in equilibrium with the atmosphere, the adherence of the electrostatically coated particles to the internal surface of the lamp is generally acceptable. However, most of the moisture must be removed from the silica before the lamp is finished. This is sometimes difficult and any appreciable residual moisture which remains can have a deleterious effect on lamp life as hereinbefore explained.

The poor hot fixture life can be remedied if very low-moisture content (<4% LOI) hydrophilic silica powder is electrostatically coated onto the lamp envelope. The life of lamps containing very low-moisture content hydrophilic silica powder burned in hot fixtures is equivalent to those burned in open air. Very low-pressure content hydrophilic silica powder, however, exhibits poor flow characteristics and tends to agglomerate, making it difficult to use with current lamp making electrostatic coating processes. It has been found that these undesirable properties of very low-moisture content hydrophilic silica may be avoided and its desirable properties may be maintained by mixing it with very finely-divided hydrophobic silica powder. Hydrophobic by definition means having no affinity for water. Hydrophobic silica powder is very free flowing and has no tendency to agglomerate. It is difficult to use by itself, though, as a lamp coating because it tends to lose adherence when exposed to lamp processing temperatures in excess of about 100° F, but by mixing hydrophobic silica with very low-moisture content hydrophilic silica the resultant powder provides an excellent coating material.

Figure 1:
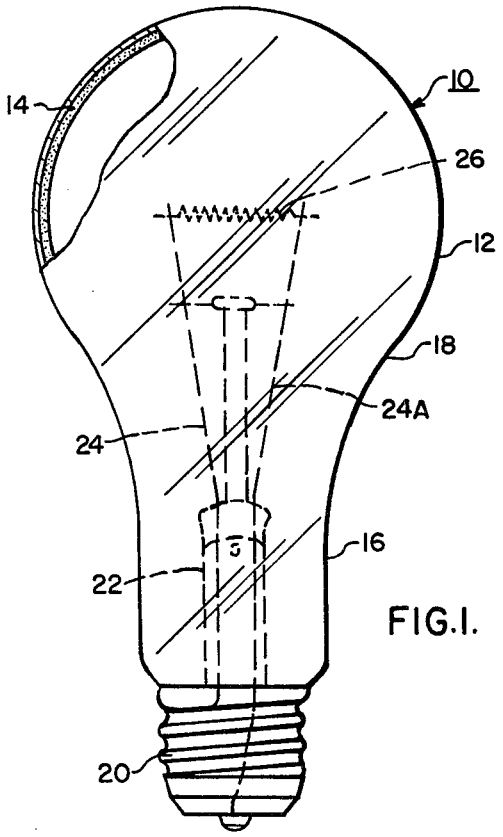
FIG. 1 is an elevational view of an incandescent lamp partially broken away showing the coating on the inner surface of the lamp envelope.

FIG. 1, in accordance with this invention, shows an incandescent lamp 10 comprising a light-transmitting vitreous envelope 12 and carrying on the internal surface thereof a thin light-diffusing coating 14 substantially comprising a mixture of very finely-divided, very low-moisture content powders. The envelope 12 has a neck portion 16 and a bulb portion 18. A metallic screwtype base 20 is cemented to the neck portion 16 to facilitate the connection to a power source, as is usual. The vitreous reentrance stem 22 is sealed to the neck portion 16. Stem 22 has lead-in conductors 24, 24a sealed therethrough. The lead-in conductors 24, 24a hold the refractory metal filament 26, such as tungsten, between their inwardly-extending extremities. The envelope preferably contains inert gas such as nitrogen, argon, krypton, etc. or mixtures thereof, as is well known, or the lamp may be a vacuum-type.

The moisture content of the powders is measured in terms of loss on ignition (LOI) or derived LOI, in which the starting LOI was approximately known and weight loss upon heating was solely attributed to moisture loss. The very low-moisture content silica powders are a mixture of predetermined amounts of hydrophilic silica (<4% LOI) and hydrophobic silica. When the hydrophilic silica powder used for the coating is "coarse", i.e., having an average particle diameter of at least 40 nm and an average surface area of less than about 65 $m^2/g$, finely divided titania is desirably included in the coating to promote adhesion to the lamp envelope. A "coarse" hydrophilic silica powder does not adhere as well to the lamp envelope, as a "fine" hydrophilic powder having a smaller particle size and larger surface area. A coating containing "coarse" hydrophilic silica powder preferably contains 40 to 95 wt.% hydrophilic silica powder, 10 to 40 wt.% hydrophobic silica powder, and 5 to 40 wt.% titania.

As a specific example, a coating containing 70 wt.% "coarse" hydrophilic silica powder such as that manufactured by the Degussa Company under the trade designation "Aerosil OX50", 10 wt.% hydrophobic silica powder, such as that manufactured by the Philadelphia Quartz Company under the trade designation "WR 50", and 10 wt.% titania ($TiO_2$) such as that manufactured by the American Cyanamide Corporation under the trade designation "Unitane", gives excellent results. The coating is free flowing with no tendency to agglomerate in the lamp coating apparatus, adheres well to the lamp envelope, gives good light diffusion and excellent hiding of lamp filament.

When the hydrophobic silica powder used in "fine", i.e., having an average particle diameter of less than about 25 nm and an average surface area of at least 100 $m^2/g$, the hydrophilic silica powder is preferably present in amount of from about 70 to 99.5 wt.% of the thin light-diffusing coating and the hydrophobic silica is present in amount of from about 0.5 to 30 wt.% of the coating. This mixture provides a lamp coating that is very adherent and that is substantially free from agglomerations.

Figure 2:
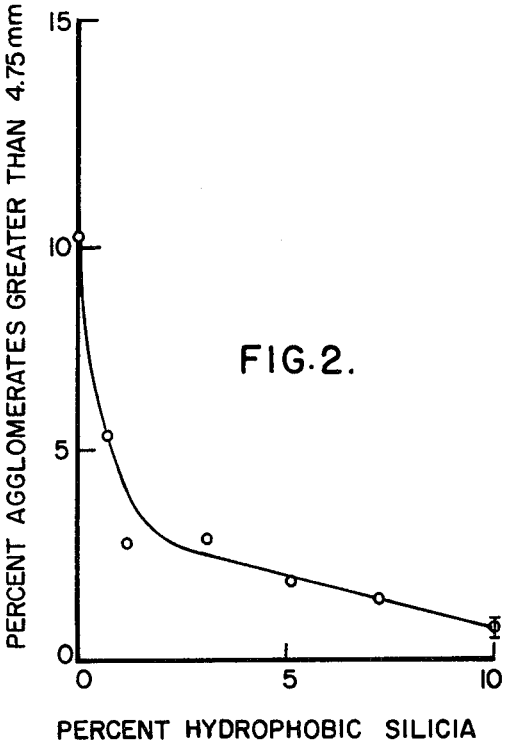
FIG. 2 is a graph of agglomerate formation in hydrophilic silica as a function of hydrophobic silica content.

As a specific example, a hydrophobic silica powder, such as that sold by the Degussa Company under the trade designation "D17", performs well. Its effect on the tendency of the "fine" hydrophilic silica powder, such as that manufactured by PPG Industries, Inc. under the trade designation "Hi Sil 233", to form agglomerate greater than 4.75 mm was tested as shown by the graph in FIG. 2. Additions of 10, 7, 5, 3, 1 and ½ wt.% of hydrophobic "D17" were added to the "fine" hydrophilic silica powder. The percentage of agglomeration greater than 4.75 mm decreased markedly with the addition of only 2 wt.% hydrophobic "D17" as shown by the graph. Adherence of a coating of 90 wt.% "fine" hydrophilic silica powder (1.3% LOI) and 10 wt.% hydrophobic silica powder "D17" was only slightly less than hydrophilic silica powder (11% LOI) by itself, and a coating of 95 wt.% "fine" hydrophilic silica powder (1.3% LOI) and 5 wt.% hydrophobic "D17" was slightly better than the adherence of hydrophilic silica powder (11% LOI) by itself. Additions of hydrophobic silica powders to the mixture in excess of 30 wt.% has been found to give less satisfactory coatings.

Figure 3:
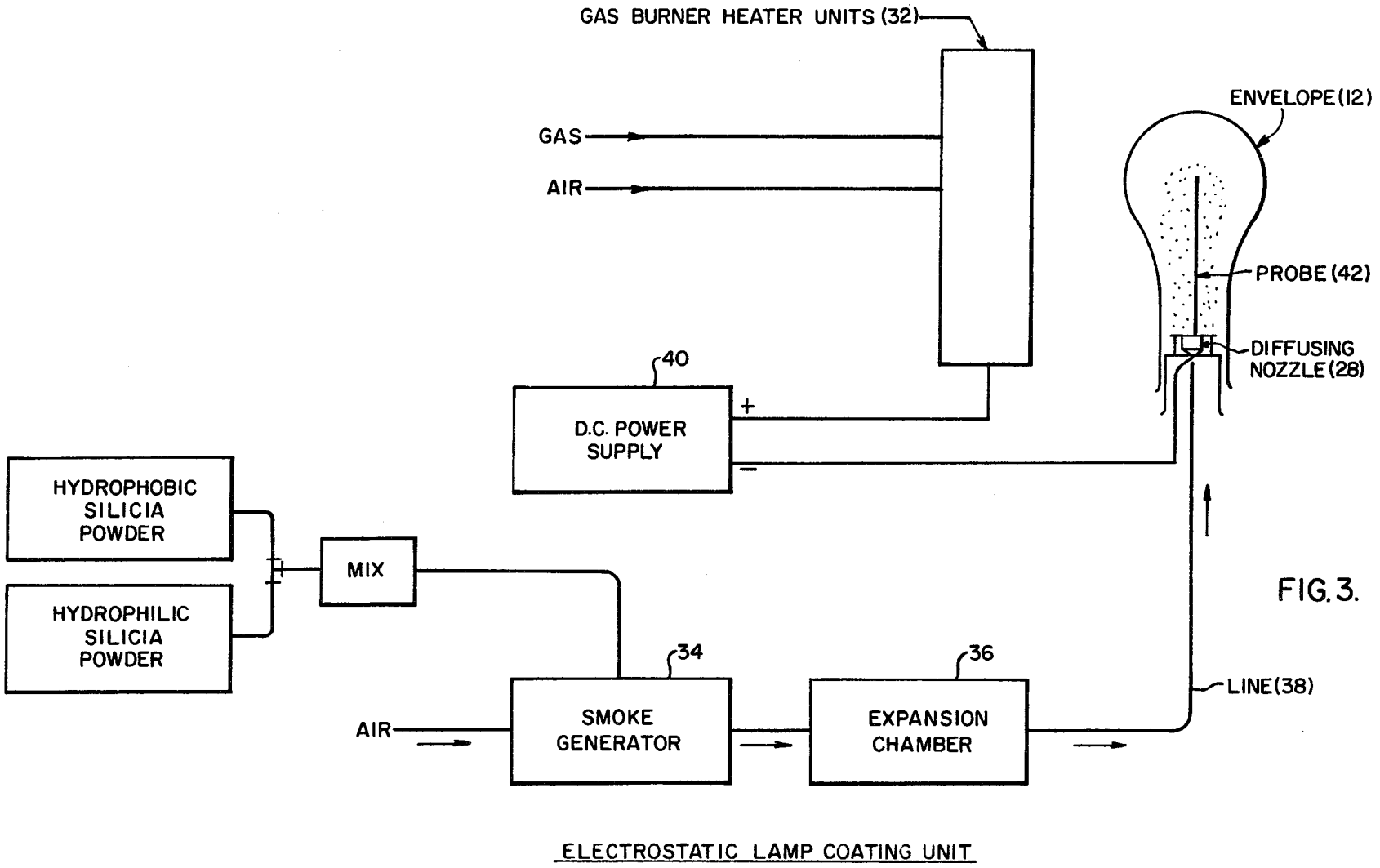
FIG. 3 is a schematic diagram showing a typical electrostatic coating unit.

FIG. 3 shows a schematic diagram of an electrostatic lamp coating unit. For further detail reference see U.S. Pat. No. 2,922,065, issued to Meister et al. In accordance with the present invention a mixture substantially comprising hydrophobic silica powder and very low-moisture hydrophilic silica powder is first formed. Very low-moisture hydrophilic silica powder may be obtained by using "coarse" hydrophilic silica powder which inherently has very low-moisture content (<4% LOI) or by drying "fine" hydrophilic silica powder having an LOI of 12%, for example, at a temperature of about 500° C for about 2 hours to obtain a residual LOI of 1.3%. Of course the temperature and time of drying can be varied. The mixture should be maintained free from additional moisture until ready for coating. The envelope 12 to be coated while being rotated is heated to about 100° C with gas burning units 32 to render it electrically conductive. A smoke generator unit 34 produces a smoke of finely-divided particles suspended in air, prior to electrostatic deposition of the powder. The air supply fed to the smoke generator is preferably regulable between 2 psi and 20 psi output pressure. The smoke is then passed into an expansion chamber where the particle-smoke pressure should be maintained between 6 and 12 psi during coating. The expansion chamber feeds into a line 38 leading to a diffusion nozzle 28 shown in FIG. 4 having a number of orifices 30 disposed on it in order to provide an even coating on the interior surface of the envelope. The positive pole of a high-tension, direct-current source 40 is electrically connected to the gas-burner unit 32 and the negative pole is electrically connected to a probe 42 which extends within the interior of the lamp envelope 12. If desired, these polarities may be reversed with little effect on the resultant coating. The magnitude of the applied D.C. voltage is not particularly critical and may vary between about 8 kv. and 25 kv., for example.

Figure 4:
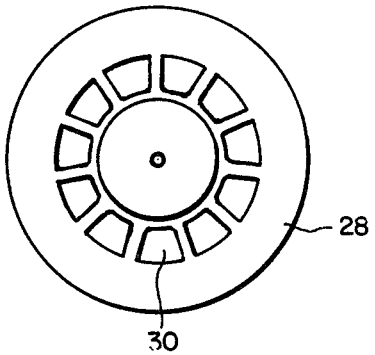
FIG. 4 is a plan view of a nozzle assembly of an electrostatic coating unit.

As a specific example for silica coating a bulb designed for a 100 watt lamp, the nozzle has a total of 11, pie-wedge shaped orifices 30 as shown in FIG. 4. Each orifice has an area of approximately 0.71 $mm^2$. The total nozzle area approaches 8.26 $mm^2$ (0.0128 $in^2$). As hereinbefore noted, the preferred pressure in the smoke generator may vary between 6 and 12 psi. In coating a bulb adapted for 100 watt operation, the smoke is introduced into the envelope for about 2 seconds while applying a high tension D.C. of 15 kv. between the envelope interior surface and the probe. This will deposit approximately 40 mg. of the mixture of hydrophobic silica powder and hydrophilic silica powder onto the interior surface of the envelope. After being coated the envelope is baked or lehred while being rotated in order to dry off the moisture which may have accumulated during coating. The lehring may be accomplished by a gas burning unit and the lehring temperature may vary considerably. For example, if the mixture of hydrophobic and hydrophilic silica powder has been fired at a temperature of about 500° C for about 2 hours, the envelope lehr of 350° C for a period of 10 to 20 seconds will normally be sufficient.

What is claimed is:

1. An incandescent lamp having a light-transmitting envelope and carrying on the internal surface of said envelope a thin light-diffusing coating substantially comprising a mixture of very finely divided silica powders, said silica powders being a mixture of of from about 40% to about 99.5% by weight hydrophilic silica having less than 4% moisture loss on ignition and the balance hydrophobic silica.

2. The lamp of claim 1 wherein said hydrophilic silica powder has an average particle diameter of at least 40 nm and an average surface area of less than about 65 $m^2/g$.

3. The lamp of claim 2, wherein said thin light-diffusing coating includes finely divided titania as an adhesion promoter.

4. The lamp of claim 3, wherein said hydrophilic silica powder is from about 40 to 95 wt.% of said thin light-diffusing coating, said hydrophobic silica powder is from about 10 to 40 wt.% of said coating, and said titania is from about 5 to 40 wt.% of said coating.

5. The lamp of claim 4, wherein said thin light-diffusing coating is 70% hydrophilic silica powder, 20% finely divided titania, and 10% hydrophobic silica powder.

6. The lamp of claim 1, wherein said hydrophilic silica powder has an average particle diameter of less than about 25 nm and an average surface area of at least 100 $m^2/g$.

7. The lamp of claim 6, wherein said hydrophilic silica powder is from about 70 to 99.5 wt.% of said thin light-diffusing coating and said hydrophobic silica powder is from about 0.5 to 30 wt.% of said coating.

8. The lamp of claim 7, wherein said hydrophilic silica powder is 90 wt.% of said thin light-diffusing coating and said hydrophobic silica powder is 10 wt.% of said coating.

9. The method of electrostatically coating the inner surface of an incandescent lamp envelope with a thin layer substantially comprising very low-moisture content, very finely-divided silica to provide a coating which is very adherent and is substantially free from agglomerations of said silica, which method comprises:

a. forming a composition comprising a finely divided mixture of from about 40% to about 99.5% by weight hydrophilic and the balance hydrophobic silica powders, and maintaining said mixture free from additional moisture until ready for coating;
b. heating said envelope to be coated to render same electrically conductive; and
c. introducing through a diffusing nozzle and into the interior of said envelope to be coated a smoke of said mixed hydrophobic silica and low-moisture content hydrophobic silica and applying an intense electric field between a location interiorly of said envelope to be coated and the conductive surface thereof to cause the silica of said smoke to deposit as a thin layer onto the interior surface of said lamp envelope.

10. The method of claim 9, wherein said lamp envelope is heated to about 100° C with gas burning heater units.

11. The method of claim 10, wherein said smoke is introduced into said envelope through a number of orifices disposed on said nozzle.

12. The method of claim 11, wherein said electric field is produced by a high voltage, direct current source electrically connected between said gas burning heater units and said nozzle.

* * * * *